US005863074A

United States Patent [19]

Wilkinson

[11] Patent Number: 5,863,074

[45] Date of Patent: Jan. 26, 1999

[54] FRAUD INHIBITING PERSONAL CHECK AND METHOD

[76] Inventor: Rudolph P. Wilkinson, 1021 Osage, Ardmore, Okla. 73401

[21] Appl. No.: 771,852

[22] Filed: Dec. 23, 1996

[51] Int. Cl.[6] ..... B42D 15/00

[52] U.S. Cl. ..... 283/58; 283/57

[58] Field of Search ..... 283/67, 70, 57, 283/58, 117; 235/375, 379, 487

[56] References Cited

U.S. PATENT DOCUMENTS

| | | | |
|---|---|---|---|
| 3,258,277 | 6/1966 | Schuster | 282/22 |
| 3,671,059 | 6/1972 | Zeller | 283/7 |
| 4,865,351 | 9/1989 | Smithson et al. | 283/58 |
| 5,075,769 | 12/1991 | Allen et al. | 358/75 |
| 5,181,786 | 1/1993 | Hujink | 400/61 |
| 5,244,235 | 9/1993 | Helgeson | 283/58 |
| 5,505,494 | 4/1996 | Belluci et al. | 283/75 |
| 5,594,226 | 1/1997 | Steger | 283/58 X |
| 5,801,365 | 9/1998 | Katz | 283/58 X |

*Primary Examiner*—Willmon Fridie, Jr.
*Attorney, Agent, or Firm*—McAfee & Taft

[57] ABSTRACT

A personal check includes a substrate defined to be written on and to be transferable from a first person to a second person. The personal check also includes: check characterizing indicia printed on the substrate, and at least three different types of identification indicia printed on the substrate such that the identification indicia are not removed from the substrate when the substrate is transferred from the first person to the second person. These identification indicia include a picture of at least the face of the first person, an alphanumeric physical parameter identifying an at least approximately visually discernable physical characteristic of the first person, and a predetermined signature of the first person. In one implementation, the check characterizing indicia and the identification indicia are interposed on the substrate. A plurality of these personal checks are comprised in a checkbook. A method for discouraging personal check fraud comprises providing to a computer system at least the aforementioned three different types of identification indicia about a personal checking account holder. The method further comprises printing with the computer system a plurality of personal checks for the account holder. This includes printing the at least three different types of identification indicia to permanently remain on each personal check.

21 Claims, 3 Drawing Sheets

AJAX NATIONAL BANK 7001
Somewhere, Ok. 73406
63-56/1020
Mr. John Doe
3525 My Street
Somewhere, Ok. 73406
PAY TO
THE ORDER OF
$
DOLLARS
[BANK ID. NO.] [ACCT. NO.]
HT. 6'2"
WT 195 LBS
EYES: BL
HAIR: GRAY
John Doe 2
2a
4
6
8
10
12
14
16
18
19
20
22
24
26
28
30
32

FRAUD INHIBITING PERSONAL CHECK AND METHOD

BACKGROUND OF THE INVENTION

This invention relates to personal checks which can inhibit fraud by someone who tries to negotiate such a check without authority from the holder of the account upon which the check is drawn. The invention also pertains to a related method of discouraging personal check fraud.

Personal checks are not new and have long been used in the banking industry as a means of transferring funds from one person or account to another person or account. As society has become more mobile, and more populated, some unlawful people now prey upon the trustful nature of some merchants by cashing stolen or otherwise worthless personal checks. Usually, the worthless checks are passed during rush hours and the dishonest person tries to take advantage of the honest merchants' inability to remember the physical characteristics of the person cashing the check. After several days have passed, and a bad check is returned from the bank, it may be difficult for the merchant to remember or accurately describe or identify the unlawful check writer.

One method of trying to prevent such fraud has included requiring photographic identification when the check is cashed or otherwise negotiated. Usually the photographs are incorporated with a driver's license, a credit card, or a passport. With this type of pictorial identification, however, the photograph bearing the identity of the person cashing the check is returned to the person that has been identified. This leaves the merchant with no tangible evidence to help recall the physical characteristics of the person that has been pictorially identified.

It has been proposed that identifying photographs be attached to personal checks for the identification of the check writer. This method, however, poses the risk of check and photograph becoming separated. Once the check and the photograph are separated, then the advantages of the combined check and photograph are lost. Also, multilayered checks (check+an attached photograph) may damage or jam the automated check processing machines that are now used by many banks. Printing a photograph of the account holder on each of the checks to be cashed was mentioned in U.S. Pat. No. 3,671,059 to Zeller (column 1, lines 17–25), but dismissed as too costly, impractical, and undesirable.

Comparing the signature of the check writer with a signature displayed on a separate document is another technique that has been used to try to prevent fraudulent use of personal checks. For many years, merchants have compared the check writer's signature on the check being cashed with the check writer's signature displayed on a driver's license, credit card, or some other identifying document. The identifying document may also include a photograph along with a signature of the check writer. After the identification process is completed, however, the identifying documents are returned to the check casher. This procedure, therefore, also fails to leave tangible memory aids with the merchant to assist him or her in recalling the physical characteristics of the check writer.

The comparative signature technique is also used to identify the proper owner of a traveler's check. When using this procedure, a traveler will prepay and purchase one or more traveler's checks. The traveler will then sign his or her signature on the face of the newly issued checks. Later, when the traveler is ready to cash a check, the check owner will again sign his or her name in order to provide comparative signatures that will help verify the check casher's proof of ownership. This procedure discourages fraudulent use of traveler's checks. Unfortunately, the traveler's check technique lacks convenience and flexibility. The traveler must first anticipate the need to acquire the traveler's checks. Next, the traveler must pre-purchase the traveler's checks. Also, the checks are issued in fixed denominations, and do not lend themselves well to many personal uses. Also, the traveler's checks do not leave a paper trail that is returned to the traveler. The paper trail is desirable because it can be used to help document personal, company, or tax deductible expenses.

Physical descriptions, such as height, weight, complexion, and the color of eyes, are often included on drivers licenses, passports and other non-transferable documents. These descriptions help identify the proper owner of the document.

Although the foregoing procedures are beneficial, they have shortcomings as mentioned above with regard to their use in conjunction with the use of personal checks. These procedures also typically require one to not only find and fill out the check, but also locate, display and return the identification material to a purse or wallet, which can be cumbersome and time consuming, especially at a busy checkout counter.

Although each of the foregoing can be useful, there is still the need for an improved personal check and method for discouraging fraudulent use of personal checks.

SUMMARY OF THE INVENTION

The present invention overcomes the above-noted and other shortcomings of the prior art by providing a novel and improved fraud inhibiting personal check and a related method of discouraging fraudulent use of personal checks.

The personal check of the present invention comprises a substrate defined to be written on and to be transferable from a first person to a second person. The personal check further comprises check characterizing indicia printed on the substrate. It also comprises at least three different types of identification indicia printed on the substrate such that the identification indicia are not removed from the substrate when the substrate is transferred from the first person to the second person. These identification indicia include: a picture of at least the face of the first person, an alphanumeric physical parameter identifying a physical characteristic of the first person at least approximately visually discernable by the second person, and a predetermined signature of the first person. In a particular implementation, the check characterizing indicia and the identification indicia are interposed on the substrate such that the identification indicia cannot be removed from the check characterizing indicia without making the personal check unusable.

The present invention also provides a checkbook comprising a plurality of checks wherein each of the checks is as defined above.

The method of the present invention for discouraging personal check fraud comprises providing to a computer system at least three different types of identification indicia about a personal checking account holder, which indicia include a picture of at least the face of the account holder, an alphanumeric physical parameter identifying an at least approximately visually discernable physical characteristic of the account holder, and a predetermined signature of the account holder. The method further comprises printing with the computer system a plurality of personal checks for the account holder. This includes printing the at least three different types of identification indicia on each personal check such that the identification indicia permanently remain with each personal check.

Accordingly, one object of the present invention is to provide a means and method that assist a merchant, or anyone else who receives a personal check, in confirming the identity of the person negotiating the check at the time of the transaction and in recalling the person's identity at a later time should the check be returned or otherwise found to be improper.

Another object of this invention is to provide a multiplicity of identification aids that can be printed on personal checks to discourage fraudulent use of the checks.

Another object of this invention is to provide a deterrent that will reduce the temptation of unlawful individuals to engage in the practice of cashing worthless checks.

Another object of this invention is to prevent or deter the theft and forgery of personal checks.

Another object of this invention is to provide law enforcement officers with a photograph, a physical description, and a handwriting specimen of an individual who engages in the unlawful practice of cashing a worthless check.

Another object of this invention is to provide a personal check that provides theft protection, is convenient to use, and will leave a "paper trail" to assist in the verification of specific financial transactions.

Therefore, from the foregoing, it is a general object of the present invention to provide a novel and improved fraud inhibiting personal check and a related method of discouraging fraudulent use of personal checks. Other and further objects, features and advantages of the present invention will be readily apparent to those skilled in the art when the following description of the preferred embodiments is read in conjunction with the accompanying drawings.

DETAILED DESCRIPTION OF THE INVENTION

Figures 1, 2:
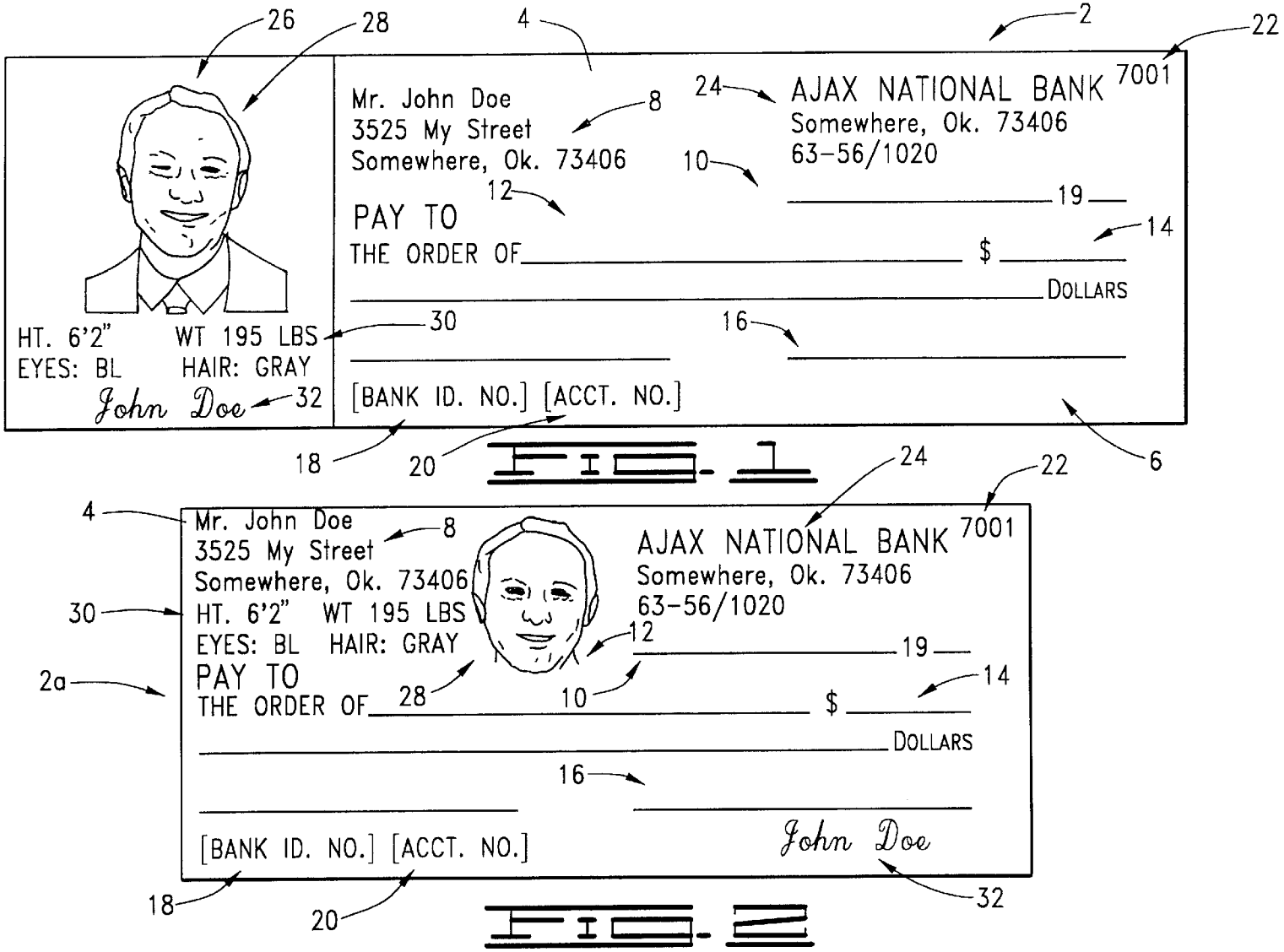
FIG. 1 is a representation of one preferred embodiment of a personal check of the present invention.
FIG. 2 is a representation of another preferred embodiment of a personal check of the present invention.

A preferred embodiment of a personal check 2 is shown in FIG. 1. The personal check 2 includes a substrate 4 which is preferably a conventional type of paper used for making checks.

Check characterizing indicia 6 are printed on the substrate. The check characterizing indicia 6 include account holder locating indicia 8 such as the name and address of the account holder who is to use the check 2. The account holder's phone number and social security number may also be printed on the substrate 4. Other check characterizing indicia include the conventional lines and symbols defining date blank indicia 10, payee blank indicia 12, dollar amount blank indicia 14 (both the numeric and text blanks), and signature line blank indicia 16. The check characterizing indicia 6 also include the bank (or other financial institution) identification number 18 and the holder's account number 20. A check number 22 is also typically included in the check characterizing indicia, as may be financial institution identifying information 24.

The personal check 2 of the present invention also includes personal identification indicia 26 printed on the substrate 4 such that the identification indicia 26 are not removed from the substrate 4 when the substrate 4 is transferred from the account holder to another person. The personal identification indicia include a picture 28 of the account holder, an alphanumeric physical parameter 30 further characterizing the account holder, and a predetermined signature 32 of the account holder.

The alphanumeric physical parameter 30 identifies a physical characteristic of the account holder. The physical characteristic is one that someone else can visually discern by looking at the person using the personal check. This characteristic is one that is subject to at least immediate visual approximation (e.g., weight or height).

More specifically, the alphanumeric physical parameter 30 preferably includes at least one physical measurement parameter identifying a size characteristic of the account holder not visible from the picture 28. In the illustrated embodiment of FIG. 1, the physical measurement parameter is at least one parameter selected from the group consisting of the height and weight of the account holder; however, in broader aspects of the invention, other physical measurement parameters can be used.

The alphanumeric physical parameter 30 also preferably includes a physical component parameter identifying a physical feature of the account holder readily discernable by one who receives the personal check when the personal check is transferred from the account holder to such other person. In the illustrated embodiment, the physical component parameter is at least one parameter selected from the group consisting of eye color and hair color; however, the physical component parameter can include other information, such as complexion or some distinctive physical feature that the recipient can readily observe.

Referring to FIG. 2, another preferred embodiment of a personal check 2*a* of the present invention is illustrated. This includes the same elements as the FIG. 1 embodiment as indicated by the same reference numeral; however, the check characterizing indicia and the personal identification indicia are interposed together on the substrate 4 such that the personal identification indicia cannot be removed from the check characterizing indicia without making the personal check unusable. That is, whereas the personal identification indicia of the FIG. 1 embodiment could be torn or cut or otherwise removed from the remainder of the substrate 4 in such a manner that might leave the remainder of the substrate 4 a legitimate negotiable check, the embodiment of FIG. 2 incorporates the personal identification indicia in the same portion of the substrate 4 as the check characterizing indicia so that one cannot be removed from the other without destroying the usefulness of the substrate 4.

Figure 3:
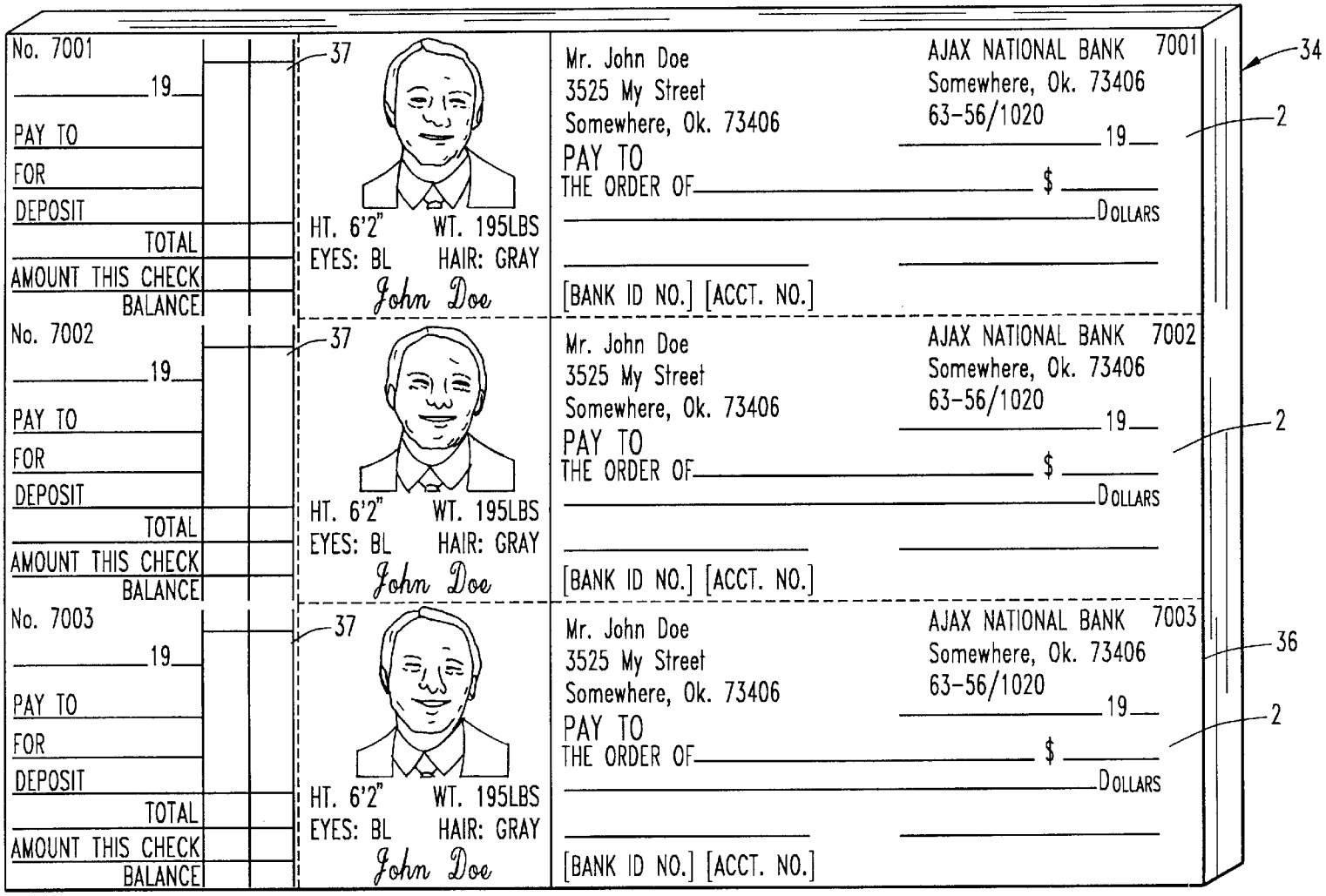
FIG. 3 is a representation of a preferred embodiment of a checkbook of the present invention.

Referring to FIG. 3, a checkbook 34 of the present invention includes a plurality of personal checks 2 of the present invention. These can be either of the embodiments shown in FIGS. 1 and 2 or any other embodiment encompassed by the present invention. As illustrated in FIG. 3, the checkbook 34 includes duplicate sheets 36 of three connected checks of the format shown in FIG. 1. Each sheet 36 is perforated between the adjacent substrates 4 of the respective checks so that the checks can be readily separated in conventional manner. Each substrate 4 is also removably connected to a check stub 37 which is to be retained by the account holder in conventional fashion.

It is also contemplated that the checkbook 34 of the present invention can take other formats, such as a conventional pocket size checkbook format with a bound group of individual checks of the present invention.

To make one or more checks of the present invention, a printing system 38 (FIG. 4) receives check characterizing input 40, picture input 42, alphanumeric input 44 and signature input 46 and outputs personal checks 2 (or 2*a* or other format) of the present invention.

The printing system 38 can be any suitable system for receiving the various inputs and printing the indicia in a nonremovable manner on a suitable substrate to produce the personal checks of the present invention. One such system includes a suitably programmed personal computer with a compatible printer, such as a laser printer. The various inputs can be provided in any suitable manner. For example, the check characterizing input 40 can be provided via a keyboard connected to the personal computer, via a preloaded disk accessed through a disk drive of the personal computer, via a scanner connected to the personal computer, or from a remote location connected via a modem or other remote connection. The picture input 42 can, for example, be received through a preloaded memory such as a disk or from a photograph whose image is input through a scanner connected to the personal computer. Another means for inputting the picture is via a digital camera connected to the personal computer. The alphanumeric input 44 can be input through a keyboard, for example. The signature input 46 can, for example, be input from a prewritten embodiment read through a scanner connected to the personal computer, or as another example the signature can be input through a writing input means by which the personal computer can directly receive a written signature. With the information stored in the computer of the printing system, it can be displayed and manipulated via a monitor and keyboard or mouse to obtain a desired layout. The computer can then print out the desired layout of the indicia onto suitable substrate material loaded in the printer of the computer system. All of the foregoing components can be implemented with known types of equipment.

Figure 4:
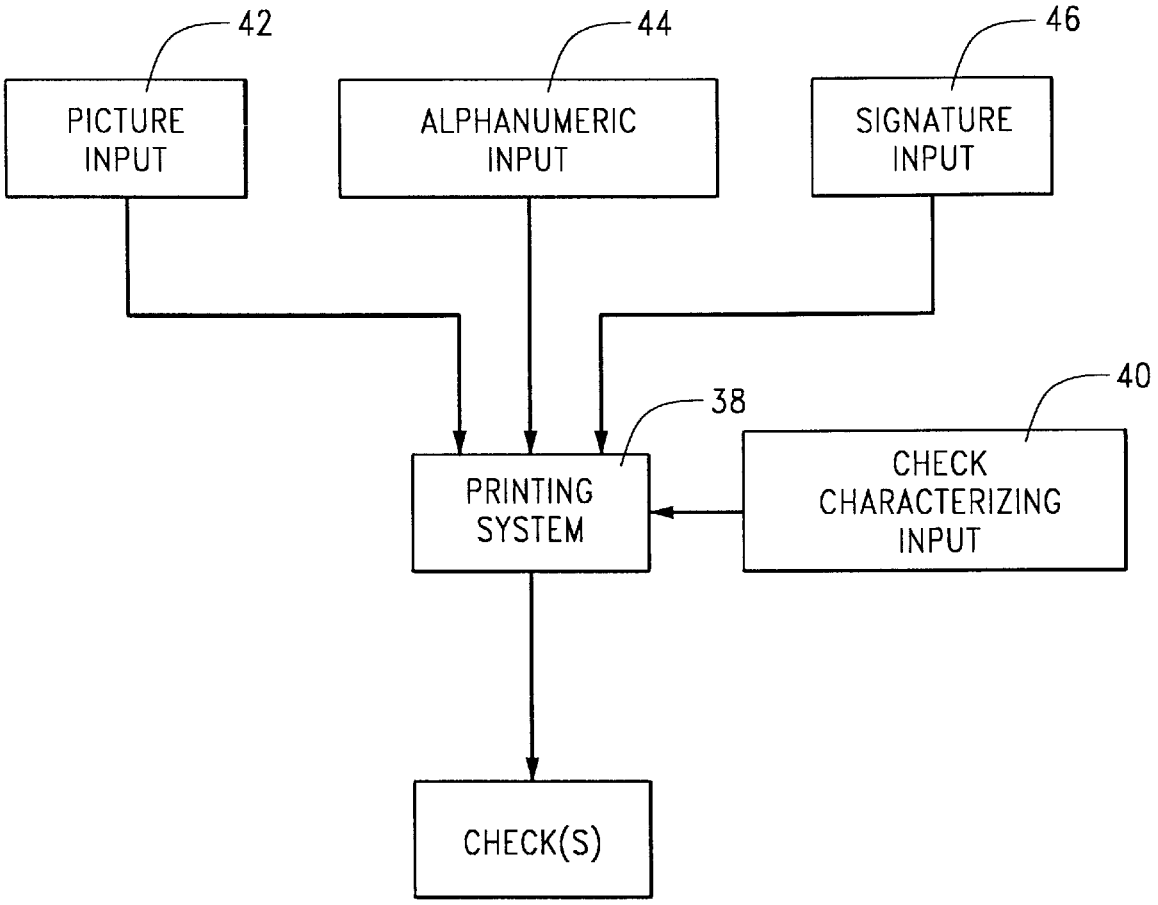
FIG. 4 is a block diagram of a system for making the personal check of the present invention.

The printing system 38 shown in FIG. 4 can be used for performing the method of the present invention. This method comprises providing to the computer of the printing system 38 at least three different types of identification indicia about a personal checking account holder. These indicia include the aforementioned picture of at least the face of the account holder, an alphanumeric physical parameter identifying an at least approximately visually discernable physical characteristic of the account holder, and a predetermined signature of the account holder. The method further comprises printing with the computer system a plurality of personal checks for the account holder. This includes printing the at least three different types of identification indicia on each personal check such that the identification indicia permanently remain with each personal check. This printing can occur such that either of the formats shown in FIGS. 1 and 2 is obtained or any other suitable format.

In a specific implementation, an account holder will have a photograph taken. Preferably the photograph will be taken with a digital camera. The digitized image, along with a digitized image of the account holder's signature is then transferred to an electronic data storage mechanism. The images are then further transferred into a computer. Once the digitized images are electronically stored within the computer, they can be manipulated and blended with the physical description and the necessary banking information of the checking account holder. A pictorial check can then be printed. The finished check contains the account holder's picture, his or her physical description, a comparative signature, and all of the bank's necessary checking information.

As shown in the pictorial illustrations, a check cashing facility should have no difficulty in comparing and identifying the person depicted on the check and the person cashing the check. If, however, the check should later prove to be fraudulent, then the check, along with the physical description and the attached photograph of the lawbreaker can be returned to the merchant by the banking institution. The merchant's returned check can then serve as evidence of the fraud, and can also provide the law enforcement officials with a picture, a physical description and a hand writing specimen of the lawbreaker.

Using the system proposed by this invention, if a check is stolen or lost, it will be difficult for someone other than the account holder to cash the check. In order to cash the check, the person will need to resemble the photograph, match the physical description, and be able to duplicate the account holder's signature. The knowledge that such tangible evidence is being left at the scene of the crime should deter potential thieves from using personal checks of the present invention as a means of obtaining money or goods by fraudulent means.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A personal check, comprising:

a substrate defined to be written on and to be transferable from a first person to a second person;

check characterizing indicia printed on said substrate; and at least three different types of identification indicia printed on said substrate such that said identification indicia are not removed from said substrate when said substrate is transferred from the first person to the second person, including:

a picture of at least the face of the first person;

an alphanumeric physical parameter identifying a physical characteristic of the first person at least approximately visually discernable by the second person; and a predetermined signature of the first person.

2. A personal check as defined in claim 1, wherein said physical parameter includes a physical measurement parameter identifying a size characteristic of the first person not visible from said picture.

3. A personal check as defined in claim 2, wherein said physical measurement parameter is at least one parameter selected from the group consisting of the height and weight of the first person.

4. A personal check as defined in claim 2, wherein said physical parameter further includes a physical component parameter identifying a physical feature of the first person readily discernible by the second person when said substrate is transferred from the first person to the second person.

5. A personal check as defined in claim 4, wherein:

said physical measurement parameter is at least one parameter selected from the group consisting of the height and weight of the first person; and said physical component parameter is at least one parameter selected from the group consisting of eye color and hair color.

6. A personal check as defined in claim 5, wherein said check characterizing indicia include at least one locating parameter of the first person selected from the group consisting of the address, phone number and social security number of the first person.

7. A personal check as defined in claim 1, wherein said physical parameter includes a physical component parameter identifying a physical feature of the first person readily discernible by the second person when said substrate is transferred from the first person to the second person.

8. A personal check as defined in claim 7, wherein said physical component parameter is at least one parameter selected from the group consisting of eye color and hair color.

9. A personal check as defined in claim 1, wherein said check characterizing indicia and said identification indicia are interposed on said substrate such that said identification indicia cannot be removed from said check characterizing indicia without making said personal check unusable.

10. A checkbook comprising a plurality of checks, each of said checks including:

a substrate defined to be written on and to be transferable from a first person to a second person;

check characterizing indicia printed on said substrate; and at least three different types of identification indicia printed on said substrate such that said identification indicia are not removed from said substrate when said substrate is transferred from the first person to the second person, including:

a picture of at least the face of the first person;

an alphanumeric physical parameter identifying a physical characteristic of the first person at least approximately visually discernable by the second person; and a predetermined signature of the first person.

11. A checkbook as defined in claim 10, wherein said physical parameter includes a physical measurement parameter identifying a size characteristic of the first person not visible from said picture.

12. A checkbook as defined in claim 11, wherein said physical measurement parameter is at least one parameter selected from the group consisting of the height and weight of the first person.

13. A checkbook as defined in claim 11, wherein said physical parameter further includes a physical component parameter identifying a physical feature of the first person readily discernible by the second person when said substrate is transferred from the first person to the second person.

14. A checkbook as defined in claim 13, wherein:

said physical measurement parameter is at least one parameter selected from the group consisting of the height and weight of the first person; and said physical component parameter is at least one parameter selected from the group consisting of eye color and hair color.

15. A checkbook as defined in claim 14, wherein said check characterizing indicia include at least one locating parameter of the first person selected from the group consisting of the address, phone number and social security number of the first person.

16. A checkbook as defined in claim 10, wherein said physical parameter includes a physical component parameter identifying a physical feature of the first person readily discernible by the second person when said substrate is transferred from the first person to the second person.

17. A checkbook as defined in claim 16, wherein said physical component parameter is at least one parameter selected from the group consisting of eye color and hair color.

18. A checkbook as defined in claim 10, wherein said check characterizing indicia and said identification indicia are interposed on said substrate such that said identification indicia cannot be removed from said check characterizing indicia of one of said checks without making said check unusable.

19. A method of discouraging personal check fraud, comprising:

providing to a computer system at least three different types of identification indicia about a personal checking account holder, which indicia include a picture of at least the face of the account holder, an alphanumeric physical parameter identifying an at least approximately visually discernable physical characteristic of the account holder, and a predetermined signature of the account holder; and printing with the computer system a plurality of personal checks for the account holder, including printing the at least three different types of identification indicia on each personal check such that the identification indicia permanently remain with each personal check.

20. A method as defined in claim 19, wherein printing the at least three different types of identification indicia includes interposing the identification indicia with check characterizing indicia on each personal check such that the identification indicia cannot be removed from the check characterizing indicia of a respective check without making the respective check unusable.

21. A personal check, comprising:

a substrate defined to be written on and to be transferable from a first person to a second person;

check characterizing indicia printed on said substrate; and at least two different types of identification indicia printed on said substrate such that said identification indicia are not removed from said substrate when said substrate is transferred from the first person to the second person, including:

a picture of at least the face of the first person; and an alphanumeric physical parameter identifying a physical characteristic of the first person at least approximately visually discernable by the second person.

* * * * *